US005929886A

United States Patent [19]

Snelling et al.

[11] Patent Number: 5,929,886

[45] Date of Patent: Jul. 27, 1999

[54] FERROELECTRIC POLYMER CHARGE TRANSFER IMAGING PROCESS

[75] Inventors: Christopher Snelling, Penfield; Dale R. Mashtare, Macedon, both of N.Y.

[73] Assignee: Xerox Corporation, Stamford, Conn.

[21] Appl. No.: 08/720,647

[22] Filed: Oct. 2, 1996

[51] Int. Cl.[6] ..... B41J 2/385; G03G 13/04

[52] U.S. Cl. ..... 347/114; 399/176

[58] Field of Search ..... 347/112–114, 141, 347/142, 55, 171, 13, 139, 140, 117, 153, 158; 399/176, 168, 170, 171; 361/225; 358/300; 430/902; 310/800; 29/25.35; 250/338.3, 338.2

[56] References Cited

U.S. PATENT DOCUMENTS 3,824,098 7/1974 Bergman et al. ..... 347/139

5,185,619 2/1993 Snelling ..... 347/114

5,678,145 10/1997 Snelling et al. ..... 347/114

*Primary Examiner*—N. Le

*Assistant Examiner*—L. Anderson

*Attorney, Agent, or Firm*—William A. Henry, II

[57] ABSTRACT

Ferroelectric polymer films are applied in a charge transfer imaging process to generate latent electrostatic images on a dielectric receiver media. The dielectric receiver media may be the final imaging substrate which is then xerographically toned and fixed, e.g., Versatec dielectric paper, or an intermediate surface from which a toned image is transferred to plain paper. Charges may be generated applying either the piezoelectric or the pyroelectric effect exhibited by ferroelectric films.

15 Claims, 2 Drawing Sheets

FERROELECTRIC POLYMER CHARGE TRANSFER IMAGING PROCESS

BACKGROUND OF THE INVENTION

The present invention relates to charge transfer imaging, and more particularly, to using a ferroelectric polymer film in a charge transfer imaging process.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate, to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

PRIOR ART

Heretofore, polyvinylidene fluoride (PVDF) film and other materials have been known to exhibit pyroelectric effects. For example, it is known that the PVDF films may be heated to induce the formation of an electrostatic charge on the surface of the film. In addition, polarization of the film, where the majority of the dipole moments are permanently aligned, increases the magnitude of the pyroelectric behavior for the film. Alternatively, other materials, such as, triglycine sulfate (TGS) may be used to produce the electrostatic charge in response to a change in temperature, as described by Crowley in "Fundamentals of Applied Electrostatics" (Wiley & Sons, New York, 1986, pp. 137–145).

Also, for example, U.S. Pat. No. 5,185,619 discloses a printer that includes the use of pyroelectric imaging members to produce prints. And Bergman et al. in U.S. Pat. No. 3,824,098 teaches an electrostatic copying device having a polymeric polyvinylidene fluoride film as a medium for producing a patterned electrostatic charge.

As discussed above, in electrostatographic reproductive devices it is necessary to charge a suitable photoconductive or reproductive surface with a charging potential prior to the formation thereon on the light image. Various means have been proposed for the application of the electrostatic charge to a photoconductive insulating body. One method of operation, for charging the photoconductive insulating body is a form of corona discharge wherein an adjacent electrode comprising one or more fine conductive bodies maintained at a high electric potential cause deposition of an electric charge on the adjacent surface of the photoconductive body.

The operation of transferring developing material from the photoreceptive member to the image support substrate is realized at a transfer station. In a conventional transfer station, transfer is achieved by applying electrostatic force fields in a transfer region sufficient to overcome forces holding the toner particles to the surface of the photoreceptive member. These electrostatic force fields operate to attract and transfer the toner particles over to the copy sheet or other image support substrate. Typically, transfer of toner images between support surfaces is accomplished via electrostatic attraction using a corona generating device. In such corona induced transfer systems, the surface of the image support substrate is placed in direct contact with the toner image while the image is supported on the photoreceptive member. Transfer is induced by "spraying" the back of the support substrate with a corona discharge having a polarity opposite that of the toner particles, thereby electrostatically attracting the toner particles to the sheet.

The critical aspect of the transfer process focuses on maintaining the same pattern and intensity of electrostatic fields as on the original latent electrostatic image being reproduced to induce transfer without causing scattering or smearing of the developer material This essential and difficult criterion is satisfied by careful control of the electrostatic fields, which, by necessity, must be high enough to effect toner transfer while being low enough so as not to cause arcing or excessive ionization at undesired locations. Such electrical disturbances can create copy or print defects by inhibiting toner transfer or by inducing uncontrolled transfer which can easily cause scattering or smearing of the development materials.

Hereinbefore, transfer and charging systems have required sources of high voltage at low current levels for maintaining the same pattern and intensity of electrostatic fields as on the original latent electrostatic image being reproduced to induce transfer. This requirement has been usually met by incorporating high voltage power supplies for feeding the coronas and bias rolls which perform such processes as precharge, development and transfer. These high voltage power supplies have added to the overall cost and weight of electrophotographic printers.

A simple, relatively inexpensive, and accurate approach that eliminates the expense and weight of traditional high voltage sources in printing systems has been a goal in the design, manufacture and use of electrophotographic and other printers. The need to provide accurate and inexpensive transfer and charging systems has become more acute, as the demand for high quality, relatively inexpensive electrophotographic printers has increased. This requirement has been usually met by incorporating high voltage power supplies. These high voltage power supplies have added to the overall cost and weight of electrophotographic printers.

SUMMARY OF THE INVENTION

Accordingly, disclosed herein is a method and apparatus for a charge transfer process using either pyroelectric or piezoelectric materials to create net charge/surface potentials. Heating a pyroelectric film, such as PVDF, with a thermal printhead induces thermal expansion which creates surface charge density changes that are used to provide required charging of the PVDF film in imagewise configuration, as well as, simultaneously provide electrical charge as required for transfer of the imagewise configuration of the charge pattern from the PVDF film to a dielectric receiver.

Alternatively, and in accordance with another aspect of the present invention, an impact printhead is used to strike a sandwich comprising a PVDF film, a dielectric receiver, and a receiver support substrate in a predetermined pattern. The impact printhead applies a mechanical strain to the PVDF film resulting in a latent electrostatic image due to the piezoelectric effect exhibited by the film. The dielectric receiver is then xerographically toned and fixed.

BRIEF DESCRIPTION OF THE DRAWINGS

The foregoing and other features of the instant invention will be apparent from a further reading of the specification, claims and from the drawings in which:

Figure 1A:
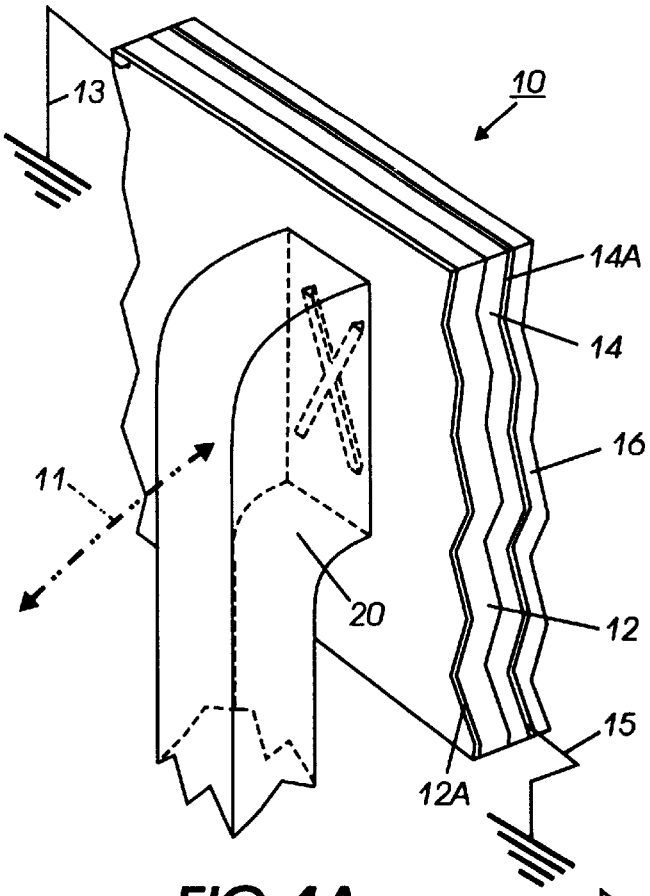
FIG. 1A illustrates an impact printhead striking a ferroelectric film that is placed on top of a dielectric substrate which is mounted on a support substrate in accordance with an aspect of the present invention.

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to preferred embodiments of the piezoelectric and pyroelectric charge transfer systems of the present invention. However, it should be understood that the piezoelectric and pyroelectric charge transfer systems of the present invention can be used with any machine in which a dielectric receiver is the final imaging substrate which is then xerogprphically toned and fixed, e.g. Versatec dielectric paper made by Versatec Corporation, San Jose, Calif. or with an intermediate surface from which a toned image is transferred to plain paper as is done, for example, in an ionographic printer made by Delphax corporation, Canton, Mass., that employs an ionographic receptor drum. Yet another example would be use of this technique to annotate the latent electrotatic image on a photoreceptor.

For a general understanding of the features of the present invention, reference is made of the drawings. In the drawings like reference numbers have been used throughout to designate identical elements.

Figure 1B:
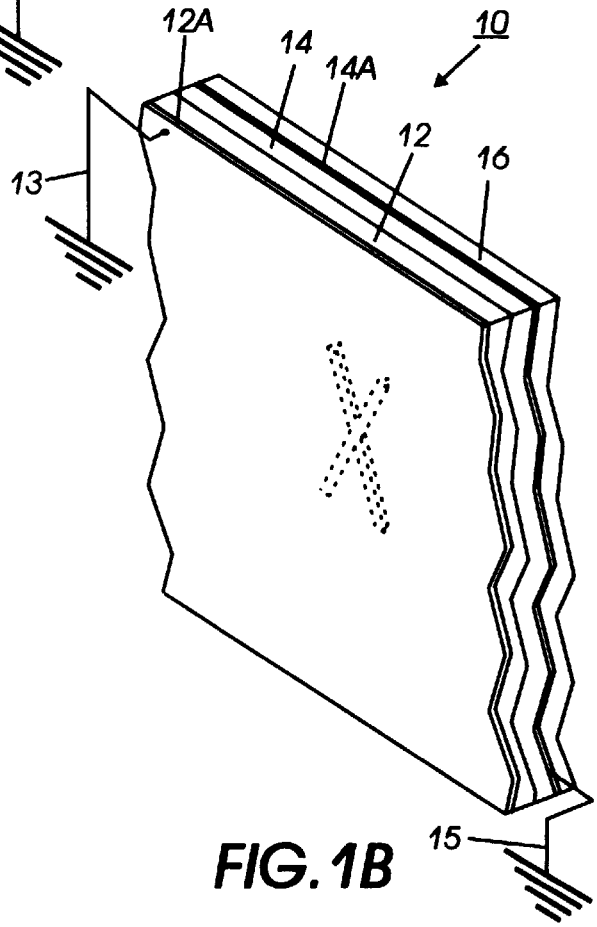
FIG. 1B illustrates the result of the impact printhead of FIG. 1A striking the ferroelectric film and dielectric substrate of FIG. 1A.

Referring now to the subject matter of the present invention, FIG. 1A depicts piezoelectric charge transfer imaging apparatus 10 that comprises an impact printhead 20 movable in the direction of arrow 11 and is adapted to impact a ferroelectric PVDF film 12 in a predetermined imagewise configuration. Film 12 is mounted in connecting relationship with a dielectric receiver 14 that in turn is mounted on a support substrate 16. An evaporated electrode surface 12A of the PVDF film 12 is grounded at 13 and dielectric receiver 14 backed by reference electrode 14A is mounted on support substrate 16 with reference electrode 14A being grounded at 15. Charge generation is a result of mechanical strain on the PVDF film 12 by impact printhead 20 resulting in a latent electrostatic image due to the piezoelectric effect exhibited by the film. The electrostatic image X shown in FIG. 1B is actually a combination of effects to include mechanical excitation in conjunction with electrical commutation of free surface charges while the film 12 is in the excited state. Upon relaxation of the film 12 to its normal state, free charges of the opposite polarity are established providing a relatively stable electrostatic latent image. Optionally, one could bias the conductive support layer 12A of the film 12 to enhance the transfer process.

In testing, and as depicted in FIG. 1A, the application of the piezoelectric effect to generate a charge pattern on a dielectric receiver media is shown. As indicated, the surface of the PVDF film 12 (available from AMP, Inc., Flexible Film Products, Valley Forge, Pa.) was contacted by impaction printhead 20 while the unmetallized PVDF surface was brought into intimate contact with the dielectric receiver surface of ferroelectric polymer 12. The conductive surface of both the PVDF film and the receiver were maintained at an electrical ground. This process has been demonstrated using both aluminized Mylar and the heretofore mentioned Delphax image receptor drum as charge receptors. The charge patterns on the receptors were then xerographically developed and electrostatically transferred to paper. Impact heads included a hand held stylus to apply point contact, as well as, a typewriter through which a PVDF/Mylar sandwich was fed. These devices served to strain the PVDF film upon mechanically contacting it resulting in surface charge generation due to the peizoelectric effect.

Figure 2:
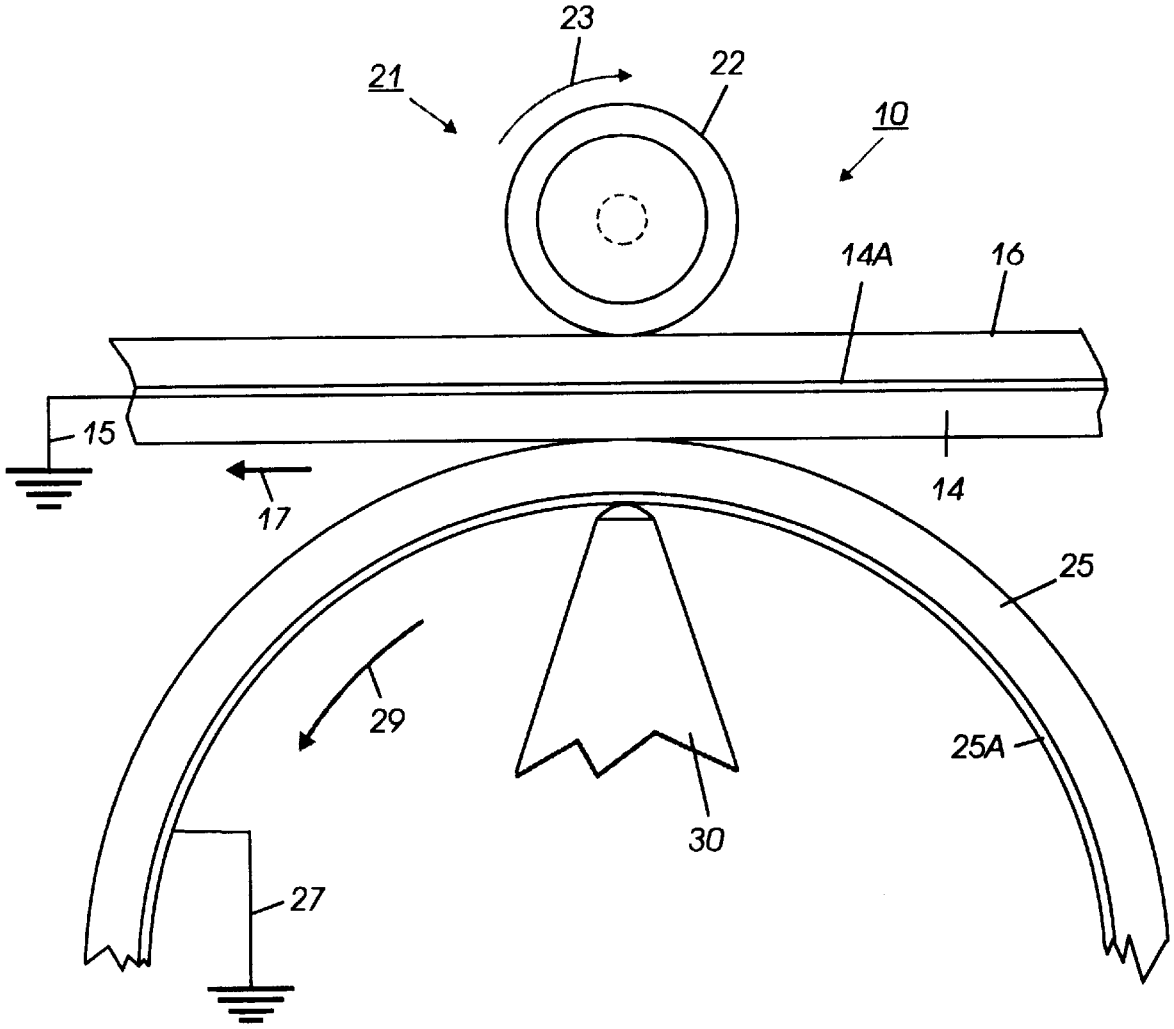
FIG. 2 illustrates a system that pyroelectrically charges a ferroelectric film in imagewise configuration in accordance with the present invention.

An alternative novel imaging approach is shown in FIG. 2 in which the pyroelectric effect of the ferroelectric polymer film 25 is applied to create a latent image which may then be transferred to a dielectric paper. Pyrograpy is a similar application in which PVDF film is thermally activated with a thermal imaging bar to result in a charge pattern which can then be xerographically developed with toner and re-heated to transfer the toner to paper. The charge generation is a result of the pyroelectric effect exhibited by the permanently polarized polymer. For the present invention, the net charge/surface potentials are created by heating the ferroelectric polymer film 25 with the heat energy generated by the thermal printhead 30. The thermal printhead contacts the metallized surface 25A of the ferroelectric polymer film 25 and metallized surface 25A is electrically grounded at 27. The dielectric media comprises a support substrate 16 and a dielectric member 14 with a metallized coating 14A thereon. The a reference electrode 14A is electrically grounded at 15. A pressure roll 21 includes outer surface 22 that is in contact with the substrate 16 is driven in the direction of the arrow 23 driving the dielectric media and ferroelectric polymer film in synchronous motion through the nip formed with the pressure roll and the thermal printhead. The pressure roll 21 ensures that the surface of the ferroelectric polymer 25, and the dielectric receiver 14, are in intimate contact. Charge is transferred from the surface of the ferroelectric film 25 to the dielectric receiver 14. For a dielectric receiver, such as dielectric coated paper, which is the final imaging substrate, the transferred latent electrostatic image can then be developed with normal xerographic development processes. Alternatively, the charge transfer imaging process can occur applying an intermediate such as the Delphax receptor surface which may then be xerographically developed and the toned image then transferred to a final imaging substrate. The charge transfer imaging process can occur without the need for high voltage supplies and is an attractive means to reduce system cost and size. In addition, elimination or reduction of the emissions which result from using devices based upon corona discharge is desirable to reduce the environmental impact of xerographic systems. These desirable results and advantages over corona charging subsystems are obtained through generation of functional net charge/surface potentials for the charge transfer step from thermal energy input to flexible PVDF material, due to its pyroelectric effect properties.

In use of the apparatus of FIG. 2, thermal printhead 30 is applied to imagewise heat the ferroelectric polymer film 25 to generate a surface charge and voltage in an imagewise fashion. A thin metal layer 25A is present on this interface surface of the film 25 to enable a known reference potential—which may be at ground potential. Typically, this metallized layer is vacuum deposited and is on the order of angstroms in thickness and will have minimal effect on heating of the film. Upon heating of the film a surface charge is generated, a portion of which is transferred to the dielectric layer 14 brought into intimate contact with an outer surface of the film. Essentially, a multilayer capacitor is formed between the thin metal layer 25A of the film and the grounded or biased pressure roll 21 used to force the intimate contact between the outer surface of the film and the dielectric receiver layer 14. This forms the basis for the charge transfer mechanism as the dielectric layer and film are separated upon exiting this pressure nip region.

By way of testing, the charge transfer process has been achieved using a thermal printhead in a Silver Reed Thermal Copier marketed by Silver Reed America, Torrance, Calif. An electrostatic image was generated on a section of PVDF film while in intimate contact with Versatec 4024-R dielectric paper. As shown in FIG. 2, a 28 $\mu$m thick PVDF film 25 was used, metallized on the surface contacting the thermal printhead 30. The polarization orientation of the film was such that a positive surface potential was observed with reference to the grounded conductive surface upon heating the film. After running the PVDF/Versatec dielectric paper past the printhead, the electrostatic image resulting on the dielectric paper was cascade developed using negative polarity 9000 type developer commercially available from Xerox Corporation, Rochester, N.Y. To demonstrate that charge transfer had occurred, the residual latent image of the opposite polarity present on the PVDF film was developed using 1075 developer material (positive polarity toner) which is also commercially available from Xerox Corporation, Rochester, N.Y.

As in the case with Pyrography, the surface potential generated on the PVDF film is proportional to the temperature change of the film suggesting that it is possible to produce a multiple gray level capable imaging system by applying thermal printhead technology which provides variable heat generation at the printhead contact. While printheads are commonly available at 400 dpi for up to 36 inches wide, increased resolution possibilities exist if the resistive heating elements are incorporated onto the PVDF film itself as in the manner of Resistive Ribbon Printing as disclosed by Keith S. Pennington et al., in "Resistive Ribbon Printing: How It's Done", Annual Guide to Ribbon & Toner, pp. 54–62, 1986, and D. Dove et al., in "High Resolution Resistive Ribbon Printing for Typesetter Application", Journal of Imaging Science, Vol. 33, No. 1, pp. 7–10, Jan./Feb., 1989.

In a continuous process mode, it would be desirable to neutralize the surface of the ferroelectric polymer film after the charge transfer has taken place. This could be done using a conductive fiber brush. This would assure consistent imaging by removing residual "ghost" images. Provided the ferroelectric film is operated below its mechanical and thermal limitations to maintain its polarization, the film may be used over and over in a continual imaging mode. Construction of a belt either seamless or sufficiently long to avoid a seam in the image region would provide the latent image generation subsystem in conjunction with either the impact or thermal printhead.

Selection of the ferroelectric polymer can be dictated based upon the process requirements. PVDF materials have been applied and are available in a range of thicknesses from 9 $\mu$m to 110 $\mu$m. The actual process of charge transfer from the ferroelectric films is not clearly understood, but believed to be a field driven contact charging event. While thin films may be preferred for resolution purposes, thicker films are capable of providing higher surface potentials. Laminates of the ferroelectric polymer onto other support materials is another possibility, but with the disadvantage of increased thickness. Alternatively, composite ferroelectric film materials could be applied which consist of piezoceramic particles in a polymer. These materials may provide advantages in terms of robustness for multiple use life.

Charge polarity of the images can be altered by selecting different ferroelectric film orientations. In fact, films of both polarities may be applied, for example, to create a highlight color process in which both polarities are deposited on a charge receptor in imagewise fashion and then developed with appropriate polarity toners.

It should now be understood that charge generation by both the piezoelectric and pyroelectric effect have been disclosed as effective for the purposes of ferroelectric charge transfer imaging. Ferroelectric charge transfer imaging is presented as a suitable process for printing and copying for a wide array of applications. The availability of dielectric media as used for electrography and wide process thermal printheads suggest a good coupling for engineering printers/copiers. Low volume printing and facsimile applications are advantaged by using either of these processes by the elimination of high voltage power supplies and expensive consumables, especially if applied for plain paper via transfer from a dielectric receptor.

While the invention has been described with reference to the structure herein disclosed, it is not confined to the details as set forth and is intended to cover any modifications and changes that may come within the scope of the following claims.

What is claimed is:

1. A charge transfer imaging apparatus, comprising:

a conductive support substrate;

a layer of pyroelectric film having first and second surfaces with said first surface surrounding and in contact with said conductive support substrate;

a thermal printhead in communication with said pyroelectric film for heating said pyroelectric film to produce surface potentials in imagewise configuration; and a dielectric receiver positioned with a surface thereof in contact with said second surface of said pyroelectric film, and wherein said thermal printhead prints onto said surface of said dielectric receiver in contact with said second surface of said pyroelectric film in an imagewise configuration.

2. The charge transfer imaging apparatus of claim 1, including a member positioned in contact with a surface of said dielectric that is removed from said second surface of said pyroelectric film for urging said dielectric receiver into contact with said layer of pyroelectric film.

3. The charge transfer imaging apparatus of claim 1, wherein said layer of pyroelectric film includes polyvinylidene fluoride.

4. The charge transfer imaging apparatus of claim 1, wherein said dielectric receiver comprises a dielectric material supported by a support material.

5. The charge transfer imaging apparatus of claim 4, wherein said dielectric receiver is an intermediate image receiving member.

6. The charge transfer imaging apparatus of claim 4, wherein said dielectric receiver is a final image receiving member.

7. A charge transfer imaging process for generating latent electrostatic images on a dielectric receiver, comprising the steps of:

providing a dielectric substrate, and wherein said dielectric substrate is provided as an intermediate image receiving substrate;

providing a layer of a permanently polarized polymer film having pyroelectric properties and adapted to be placed in contacting relation said dielectric substrate; and positioning a thermal printhead in communication with said permanently polarized polymer film for heating said permanently polarized polymer film to produce surface potentials on said permanently polarized polymer film in imagewise configuration such that images are charged and transferred onto said dielectric substrate.

8. A charge transfer imaging apparatus, comprising:

a conductive support substrate;

a dielectric receiver in contacting relationship with said conductive support substrate;

a layer of a permanently polarized polymer film in contact with said dielectric receiver; and an impact printhead positioned to contact said permanently polarized polymer film to mechanically strain said permanently polarized polymer film resulting in a latent electrostatic image being deposited onto said dielectric receiver due to piezoelectric effects exhibited by said permanently polarized polymer film.

9. The charge transfer imaging apparatus of claim 8, wherein said impact printhead prints onto said dielectric receiver in imagewise configuration.

10. The charge transfer imaging apparatus of claim 9, wherein said layer of permanently polarized polymer film includes polyvinylidene fluoride.

11. The charge transfer imaging apparatus of claim 10, wherein said dielectric receiver comprises a dielectric material supported by a support material.

12. The charge transfer imaging apparatus of claim 11, wherein said dielectric receiver is an intermediate image receiving member.

13. The charge transfer imaging apparatus of claim 11, wherein said dielectric receiver is a final image receiving member.

14. A charge transfer imaging apparatus, comprising:

a conductive support substrate;

a layer of pyroelectric film surrounding said conductive support substrate;

a thermal printhead positioned adjacent to and in communication with said pyroelectric film for heating said pyroelectric film to produce surface potentials in imagewise configuration; and a dielectric receiver positioned in contacting relationship with an outer surface of said layer of pyroelectric film, and wherein said thermal printhead prints onto said dielectric receiver in an imagewise configuration.

15. A charge transfer imaging process for generating latent electrostatic images on a dielectric receiver, comprising the steps of:

providing a dielectric substrate, and wherein said dielectric substrate is provided as a final image receiving substrate;

providing a layer of a permanently polarized polymer film having pyroelectric properties and adapted to be placed in contacting relation said dielectric substrate; and positioning a thermal printhead in communication with said permanently polarized polymer film for heating said permanently polarized polymer film to produce surface potentials on said permanently polarized polymer film in imagewise configuration such that images are charged and transferred onto said dielectric substrate.

* * * * *